US005412169A

United States Patent [19]

Comerci et al.

[11] Patent Number: 5,412,169

[45] Date of Patent: May 2, 1995

[54] ROCKER SWITCH WITH IMPROVED ROCKER ACTUATOR

[75] Inventors: Joseph D. Comerci, Elmhurst; Robert DeRoss, Naperville; Robert M. Fuerst, Maple Park; Todd A. Hester, Montgomery; Edward S. Sommer, Addison, all of Ill.

[73] Assignee: Molex Incorporated, Lisle, Ill.

[21] Appl. No.: 41,929

[22] Filed: Apr. 2, 1993

Related U.S. Application Data

[63] Continuation of Ser. No. 881,927, May 12, 1992, abandoned.

[51] Int. Cl.[6] ..... H01H 23/00

[52] U.S. Cl. ..... 200/339; 200/513

[58] Field of Search ..... 200/339, 513, 512, 557

[56] References Cited

U.S. PATENT DOCUMENTS

| | | | |
|---|---|---|---|
| 4,536,625 | 8/1985 | Bebie | 200/339 X |
| 4,710,602 | 12/1987 | Baity et al. | 200/315 |
| 4,896,003 | 1/1990 | Hsieh | 200/339 X |
| 5,089,677 | 2/1992 | Satou | 220/339 |

FOREIGN PATENT DOCUMENTS

| | | | |
|---|---|---|---|
| 2554630 | 5/1985 | France | 200/513 |
| 3637819 | 5/1987 | Germany | 200/513 |
| 1259356 | 1/1972 | United Kingdom | 200/339 |

*Primary Examiner*—Renee S. Luebke

*Attorney, Agent, or Firm*—Stephen Z. Weiss

[57] ABSTRACT

An electrical switch assembly is disclosed to include a housing mounting a pair of spaced switches. A rocker actuator is rockably mounted for movement relative to the housing about a rotational axis between the spaced switches, and with wing portions of the actuator on opposite sides of the rotational axis provided for alternatingly actuating the pair of switches. The rocker actuator is a one-piece component and includes a relatively stiff rocker arm rockable about the rotational axis, a connecting flange projecting outwardly from the periphery of the rocker arm, and an integral flexible intermediate wall joining the rocker arm and the connecting flange. The flexible intermediate wall supports the rocker arm in a neutral position. However, the rocker arm flexes the intermediate wall when the rocker arm is rotated about the axis in either opposite direction from the neutral position to alternate actuating positions. The flexible intermediate wall is of a material to return the rocker arm automatically to the neutral position when pressure on the rocker arm is released.

6 Claims, 2 Drawing Sheets

ROCKER SWITCH WITH IMPROVED ROCKER ACTUATOR

This is a continuation of application Ser. No. 07/881,927, filed on May 12, 1992, now abandoned.

FIELD OF THE INVENTION

This invention generally relates to the art of electrical switches and, particularly, to an electrical switch assembly having a rocker actuator rockably mounted about a rotational axis.

BACKGROUND OF THE INVENTION

Rocker switches are used in a variety of applications for alternatingly actuating a pair of switches of a switching unit. A rocker-type electrical switch assembly generally includes a rocker actuator rockably mounted about a rotational axis overlying the switch unit, with wing portions of the rocker actuator projecting from opposite sides of the rotational axis for alternatingly engaging depressible operators of the switch unit. In other words, the rocker actuator pivots in a seesaw fashion to actuate one or the other of a pair of switch operators. The switches of the switching unit may be of various types, such as momentary switches, micro-switches or the like.

One of the problems with rocker-type switches is that they often are used in low-cost environments. However, the rocker switch assembly, itself, usually is a comparatively high-cost item because such switch assemblies, heretofore, have been relatively complicated and/or included numerous components such as housing parts, mounting parts and fastening components to maintain the parts in assembled condition. Such expenses are particularly bothersome when the switch unit, itself, which is used within the rocker switch assembly often is a readily obtainable self-contained unit. Co-pending application Ser. No. 07/793,752, filed Nov. 18, 1991, and assigned to the assignee of this invention, shows an improved rocker switch assembly which considerably reduces the costs of such apparatus by providing an assembly which is modular in concept to the extent that the various parts of the switch assembly are easily snap-fit together without extraneous components, latching devices or the like.

This invention is directed to further improvements in rocker-type switches, particularly in the area of the rocker actuator. Specifically, one of the problems with rocker switches is that they often are subject to abuse. The rocker arm of the actuator often is literally struck or pounded by an operator rather than gently pivoted as is more appropriate. This causes the pivot connections, the means for returning the rocker arm to a neutral position and other interengaging means between the rocker arm or actuator and the switch housing to become excessively worn or even broken. This invention is directed to solving such problems by providing a rocker switch with a novel rocker actuator which is a one-piece component fabricated of durable material and which includes integral return means for the rocker arm.

SUMMARY OF THE INVENTION

An object, therefore, of the invention is to provide a new and improved electrical switch assembly of the rocker actuator type.

Specifically, the electrical switch assembly includes a housing mounting a pair of spaced switch means. A rocker actuator is rockably mounted for movement relative to the housing about a rotational axis between the spaced switch means, with wing portions on opposite sides of the rotational axis for alternatingly actuating the pair of switch means.

The invention contemplates that the rocker actuator, generally, includes a relatively stiff rocker arm rockable about the rotational axis, a connecting flange means projecting away from the periphery of the rocker arm, and integral intermediate wall means joining the rocker arm and the connecting flange means and supporting the rocker arm in a neutral position. In operation, the rocker arm is fixed to the housing by the connecting flange means and flexes the intermediate wall means when the rocker arm is rotated about its axis in either opposite direction from the neutral position to alternate actuating positions. The flexible intermediate wall means is of a material to return the rocker arm automatically to the neutral position when pressure on the rocker arm is released.

More particularly, the rocker actuator is provided as a one-piece component fabricated of silicone rubber or the like and which readily can be unitarily molded. The flexible intermediate wall means is integral between the rocker arm and the connecting flange means of the actuator. The rocker arm includes an integral fulcrum means depending from the underside thereof to define the rotational axis of the actuator. The connecting flange means and the flexible intermediate wall means extend substantially continuously about the periphery of the rocker arm. The rocker arm further includes a pair of integral switch actuating means depending from the underside thereof and spaced on opposite sides of the integral fulcrum. Conductive means are fixed to bottom ends of the actuating means to effect switching functions in the switch assembly.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
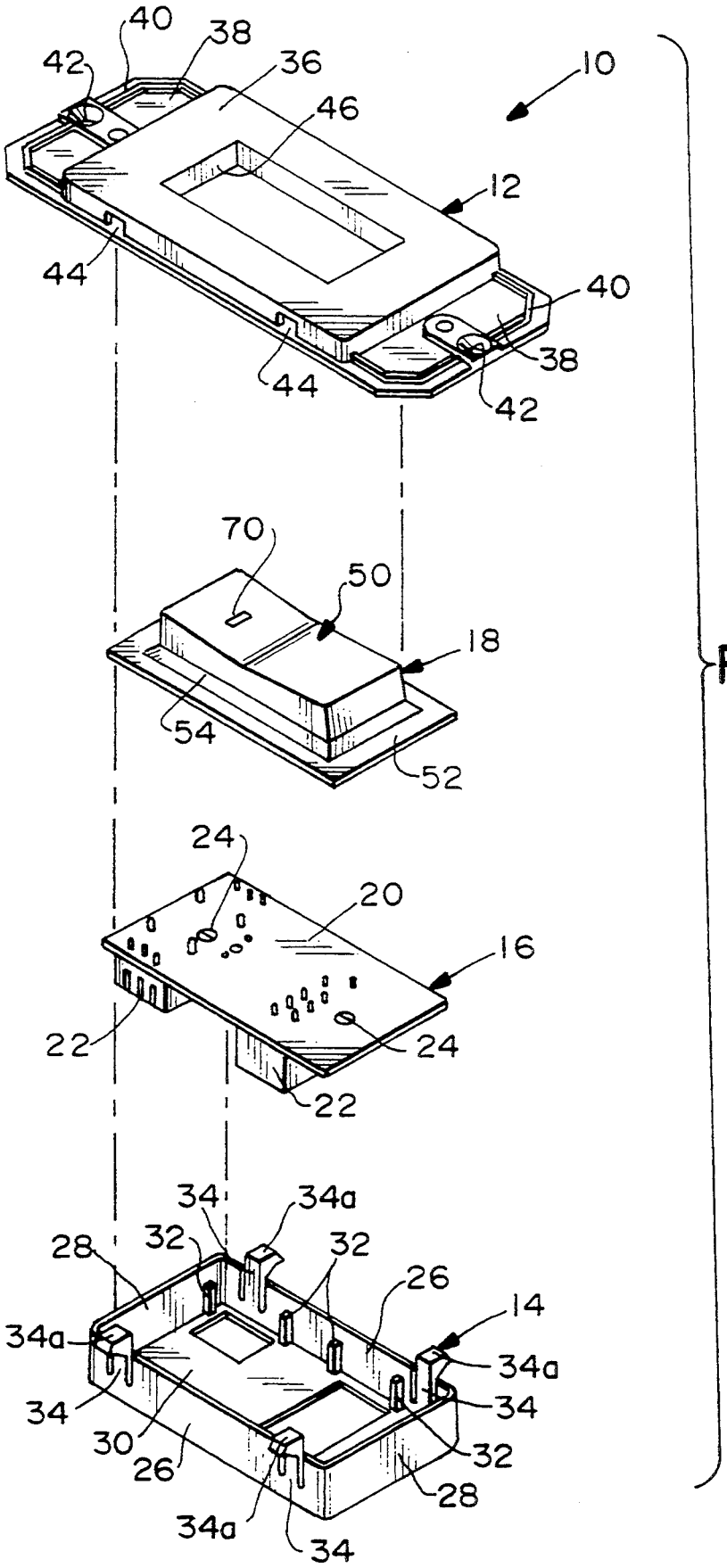
FIG. 1 is an exploded perspective view of an electrical switch assembly incorporating the improved rocker actuator of the invention.
Figure 2:
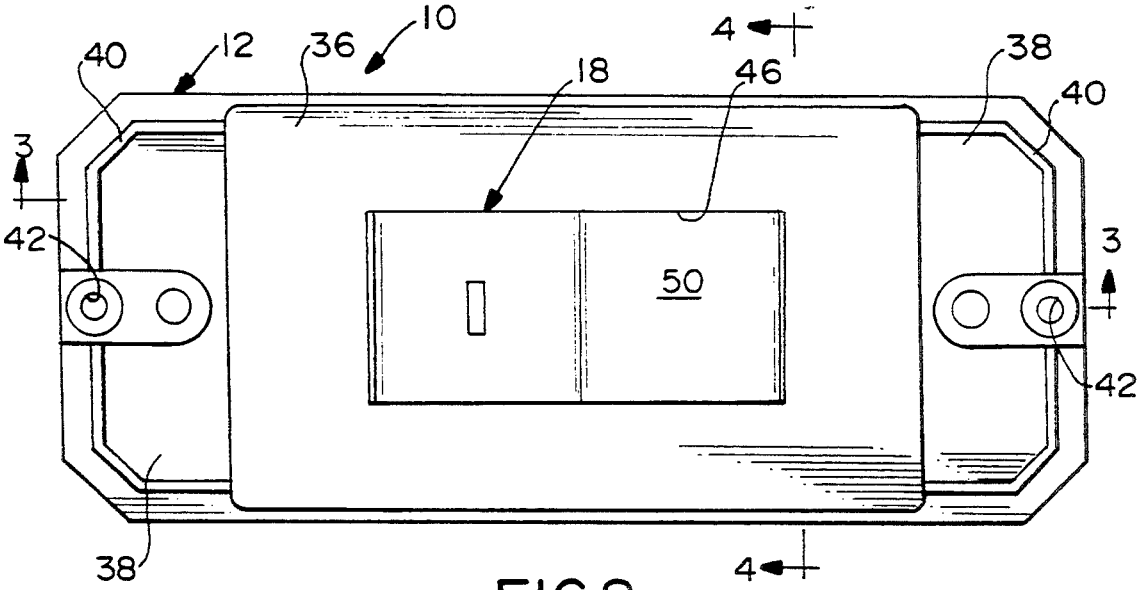
FIG. 2 is a top plan view of the switch assembly in assembled condition.

Referring to the drawings in greater detail, and first to FIG. 1, the invention is incorporated in an electrical switch assembly, generally designated 10, which includes a two-part housing formed by an upper or front housing part, generally designated 12, and a bottom or rear housing part, generally designated 14, for mounting a self-contained switch unit, generally designated 16, therewithin. The switch unit is actuated by a rocker actuator, generally designated 18, embodying the concepts of the invention.

More specifically, self-contained switch unit 16 is a sub-assembly which includes a printed circuit board 20. The printed circuit board 20 has circuit traces which form two bifurcated pads 24. Each switch pad 24 has a pair of spaced conductive pad portions which, when shorted or interconnected, complete a circuit through appropriate traces on the printed circuit board.

Figure 3:
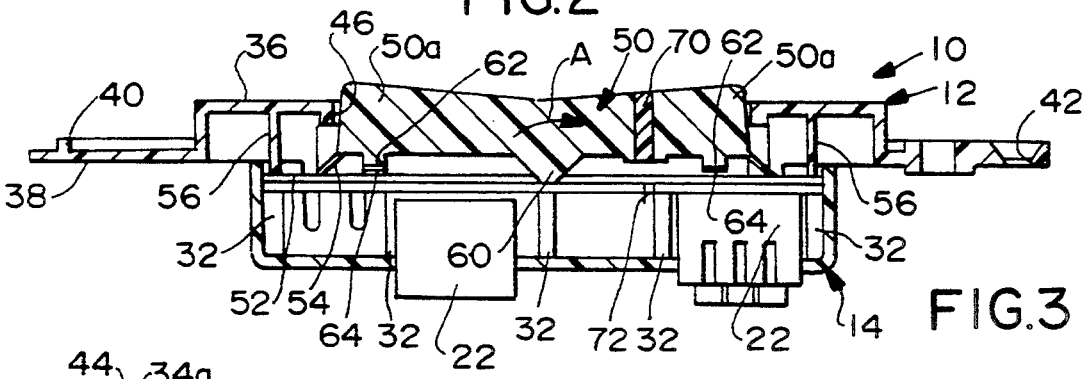
FIG. 3 is a vertical section taken generally along line 3—3 of FIG. 2.
Figure 4:
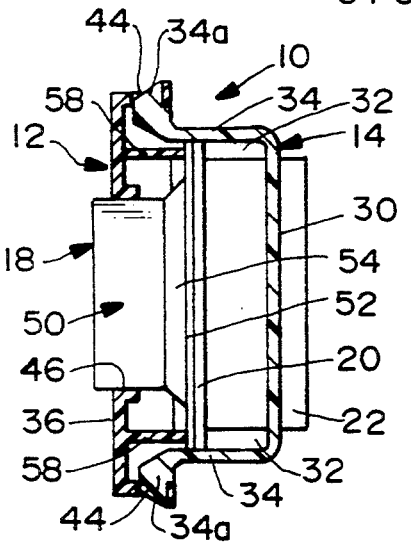
FIG. 4 is a vertical section taken generally along line 4—4 of FIG. 2.

Referring to FIGS. 3 and 4 in conjunction with FIG. 1, rear housing part 14 is provided as a base part or receptacle for mounting self-contained switch unit 16 therewithin, and front housing part 12 is provided as a cover part for enclosing the self-contained switch unit as well as rockably mounting rocker actuator 18, as described hereinafter.

More particularly, rear housing part 14 is unitarily molded of dielectric material such as rigid plastic or the like. The rear housing part includes a pair of side walls 26, a pair of end walls 28 and a bottom wall 30 defining a cup-like receptacle for receiving self-contained switch unit 16. A plurality of spacer mounting bosses 32 are molded integrally at the juncture of the side walls and the bottom wall of the rear housing part, with the upper distal ends or surfaces of the bosses defining a plane for supporting the underside of printed circuit board 20 of switch unit 16 about the periphery of the board. The rear housing part further includes a plurality of latch arms 34 molded integrally therewith and including upper, outwardly directed latch hooks **34*a***.

Front housing part 12 includes a central housing portion 36, with generally planar flange portions 38 projecting outwardly from opposite ends thereof. Like rear housing part 14, front housing part 12 is unitarily molded of dielectric material such as rigid plastic or the like and includes reinforcing or stiffening ribs 40 molded integrally with the top of flange portions 38. Mounting holes 42 are provided through the flange portions for mounting the entire switch assembly 10 to an appropriate support structure. A pair of latch apertures 44 are provided through the sides of central housing portion 36 for latching front housing part 12 onto rear housing part 14, as described hereinafter. Lastly, central housing portion 36 includes a large through aperture 46 through which a rocker arm of rocker actuator 18 projects, again as described hereinafter.

Front housing part 12 is assembled to rear housing part 14 simply by placing the front housing part on top of the rear housing part and pressing the parts together until latch hook portions **34*a* of the latch arms 34 of the rear housing part snap into and project outwardly through latch apertures 44 in the front housing part, as best seen in FIG. 4. When so assembled, flange portions 38 at the ends of the front housing part project outwardly from opposite ends of the rear housing part, as best seen in FIG. 3**, for mounting the entire switch assembly to a support structure.

Figure 5:
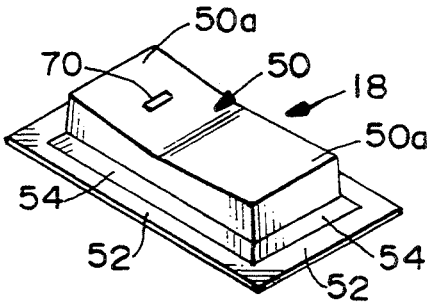
FIG. 5 is an enlarged perspective view of the rocker actuator of the invention.
Figure 6:
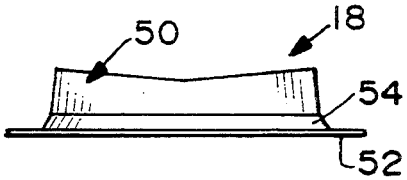
FIG. 6 is a side elevational view of the rocker actuator of FIG. 5.
Figure 7:
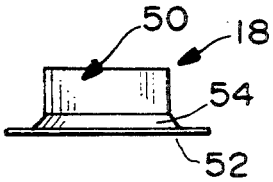
FIG. 7 is an end elevational view of the rocker actuator.

Rocker actuator 18 is a unitarily molded, one-piece component of a material such as silicone rubber. Therefore, the thicker the material, the more rigid will be the structure. Referring to FIGS. 5–7, rocker actuator 18 includes a relatively stiff rocker arm, generally designated 50, a connecting flange means 52 projecting outwardly from the rocker arm about the periphery thereof and an integral intermediate wall means 54 joining rocker arm 50 and connecting flange 52 and supporting the rocker arm in a "neutral" position as described hereinafter. As stated above, with the entire rocker actuator 18 being unitarily molded of such material as silicone rubber or the like, the thicker the material, the more rigid will be the particular portion of the actuator. Therefore, although not limiting, an actual rocker actuator 18 has been fabricated with peripheral connecting flange means 52 being on the order of 0.040 inch thick, intermediate wall means 54 being on the order of 0.020 inch thick and rocker arm 50 being on the order of 0.300 inch thick or greater. Therefore, rocker arm 50 is relatively stiff in comparison to the flexibility of intermediate wall means 54.

With the above understanding of the construction of rocker actuator 18, reference is made back to FIGS. 3 and 4 where the assembly of the rocker actuator within switch assembly 10 is illustrated. Specifically, front housing part 12 has a pair of end ribs 56 (FIG. 3) and a pair of side ribs 58 (FIG. 4) molded integrally with and depending from the underside of central housing portion 36 of the front housing part. In assembly, it can be seen that these ribs are in alignment with connecting flange means 52 about the periphery of rocker actuator 18. In essence, in assembled condition, connecting flange means 52 are sandwiched between the lower edges of ribs 56 and 58 and the top surface of printed circuit board 20 which, in turn, is seated on the top of mounting bosses 32 of rear housing part 14.

In assembly, after the self-contained switch unit 16 is positioned within the receptacle defined by rear housing part 14 (i.e. onto the tops of mounting bosses 32), as described above, rocker actuator 16 is positioned on top of the printed circuit board of the switch unit. Front housing part 12 then is assembled onto the rear housing part, as described above, whereupon latch hooks **34*a* of latch arms 34 of the rear housing part snap into latch apertures 44 of the upper housing part. In this assembled condition, connecting flange means 52 about the periphery of rocker actuator 18 is fixed within the assembly, as described, with actuator arm 50 projecting upwardly through aperture 46** in the upper housing part for access by an operator.

Before proceeding with the operation of switch assembly 10, particular reference is made to FIG. 3 wherein it can be seen that a fulcrum 60 is molded integrally with and depends from the underside of rocker arm 50 of rocker actuator 18. The fulcrum seats against the top surface of printed circuit board 20 whereby rocker arm 50 can rock in the direction of double-headed arrow "A" (FIG. 3) about a rotational axis defined by the fulcrum. In addition, switch actuating means in the form of bosses 62 are molded integrally with and depend from the underside of rocker arm 50. Each actuating boss 62 has a conductive switch pad 64 as, for example, a carbonized pill fixed to the underside thereof. These conductive switch pads are of a size such that, when moved into engagement with bifurcated switch pads 24 (FIG. 1) of printed circuit board 20, the switch pads 64 will short the bifurcated pads to complete a circuit therethrough.

It should be noted in FIG. 3 that switch actuating bosses 62, along with switch pads 64, are elevated from printed circuit board 20 and bifurcated pads 24 when rocker actuator 18 is in its neutral position, as shown. Rocker arm 50 is elongated and, in essence, defines a pair of wings 50a which are movable about the rotational axis defined by fulcrum 60, with actuating bosses 62 and switch pads 64 depending from the undersides of the wings.

In operation, when an operator depresses either wing portion 50a of rocker arm 50, the rocker arm will rock or pivot about the rotational axis defined by fulcrum 60, whereupon the conductive switch pad 64 on the bottom of the actuating boss 64 depending from the underside of the depressed wing **50*a* will engage a respective one of the bifurcated pads 24 on switch unit 16, closing a circuit therethrough. When the operator releases pressure on the particular wing 50*a* of rocker arm 50, flexible intermediate wall means 54 will return the rocker arm automatically to its neutral position, as shown, due to the resiliency of the material of the intermediate wall means. No other spring means or other biasing means are required to return the rocker arm to its neutral position. Therefore, all extraneous components are obviated due to the unitary or one-piece construction of rocker actuator 18**.

Lastly, as seen in FIG. 3, a transparent light-transmitting plug 70 may be insert-molded within rocker arm 50 above a light 72 on printed circuit board 20. The light may be electrically connected in the circuitry of the board such that whenever one of the conductive switch pads 64 on the underside of rocker arm 50 closes a circuit with one of the bifurcated pads 24 on the board, the light will be energized, transmitting light through plug 70, to indicate that the appropriate circuit has been made.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical switch assembly which includes a housing mounting a pair of spaced switch means on a printed circuit board, and a rocker actuator rockably mounted for movement relative to said printed circuit board about a rotational axis between the spaced switch means and with wing portions on opposite sides of the rotational axis for alternatingly actuating the pair of switch means, wherein the improvement comprises said rocker actuator being a one piece component and including a relatively stiff rocker arm rockable about a relatively stiff fulcrum having a tip, integral to said rocker actuator defining said rotational axis and the tip of the fulcrum in contact with a surface of said printed circuit board, a connecting flange means projecting away from the periphery of the rocker arm, and integral flexible intermediate wall means joining the rocker arm and the connecting flange means and supporting the rocker arm in a neutral position whereby the rocker arm flexes the intermediate wall means when the rocker arm is rotated about said axis in either opposite direction from the neutral position to alternate actuating positions, and the flexible intermediate wall means is of a material to return the rocker arm automatically to the neutral position when pressure on the rocker arm is released and said improvement further comprises a front housing part having ribs in alignment with said connecting flange means which forces said flange means against said printed circuit board surface whereby the rocker actuator flange means is sandwiched between said printed circuit board surface and said ribs.

2. In an electrical switch assembly as set forth in claim 1, wherein said rocker actuator comprises a one-piece component with the flexible intermediate wall means being integral between the rocker arm and the connecting flange means.

3. In an electrical switch assembly as set forth in claim 2, wherein said connecting flange means and said flexible intermediate wall means extend substantially continuously about the periphery of the rocker arm.

4. In an electrical switch assembly as set forth in claim 2, wherein said rocker actuator is fabricated of silicone rubber, the rocker arm being considerably thicker than said flexible intermediate wall means.

5. In an electrical switch assembly as set forth in claim 2, wherein said rocker arm includes a pair of integral switch actuating means depending from the underside thereof and spaced on opposite sides of the rotational axis.

6. In an electrical switch assembly as set forth in claim 5, wherein said integral switch actuating means include unitary portions of the rocker arm with conductive means fixed thereto.

* * * * *